US007451875B1

(12) United States Patent
Norris

(10) Patent No.: US 7,451,875 B1
(45) Date of Patent: Nov. 18, 2008

(54) NESTING SYSTEM FOR STORING CONTAINERS

(76) Inventor: Karen Norris, 99 Beaver Dam Rd., Islip, NY (US) 11751

( * ) Notice: Subject to any disclaimer, the term of this patent is extended or adjusted under 35 U.S.C. 154(b) by 249 days.

(21) Appl. No.: 10/705,569

(22) Filed: Nov. 10, 2003

(51) Int. Cl.
*B65D 21/06* (2006.01)

(52) U.S. Cl. ..... 206/514; 206/501

(58) Field of Classification Search ..... 206/514, 206/501, 503, 505
See application file for complete search history.

(56) References Cited

U.S. PATENT DOCUMENTS 5,586,656 A * 12/1996 Abrums ..... 206/501
5,670,118 A * 9/1997 Sponholtz ..... 422/102
5,692,617 A * 12/1997 Adams ..... 206/508
5,709,314 A * 1/1998 Petry ..... 220/802
5,799,792 A * 9/1998 Abrums ..... 206/508

* cited by examiner

*Primary Examiner*—Stephen J. Castellano
(74) *Attorney, Agent, or Firm*—Michael I Kroll

(57) ABSTRACT

A container storage system includes a plurality of containers, wherein each container is of a different size. Each container includes a base and wall extending up from and perpendicular to the base forming a pool therein. A first lip extends around a periphery of the wall outside the pool on a side opposite the base. A second lip extends around a periphery of the wall outside the pool on a side adjacent the base. The container further includes a lid having a shape and size that corresponds with a shape and size of the base. The lid has a retaining channel that extends around a periphery thereof for releasably receiving one of the first and second lips for releasably securing the lid to at least one of an open end of said container and the base of said container.

3 Claims, 12 Drawing Sheets

NESTING SYSTEM FOR STORING CONTAINERS

BACKGROUND OF THE INVENTION

1. Field of the Invention

The present invention relates generally to container storage systems and, more specifically, to a space saving container storage system wherein a plurality of containers having similar shapes but different sizes may fit one inside the other. Each container includes a lid which is releasably securable to both an open end of the container and a base of the container. Each lid has a unique color which corresponds to the color of the outer edge of the base of its matching container for easy storage thereof.

2. Description of the Prior Art

Storage containers, such as those manufactured by Tupperware®, frequently come in an assortment of shapes and sizes. However, the method of storing these containers is spatially inefficient and requires nesting containers one in side the other while separating each container from its corresponding lid. This separation of corresponding parts causes difficulty upon later user thereof.

Numerous other stackable containers exist in the prior art. Typical of these is U.S. Pat. No. 1,778,175 issued to E. E. Thune on Oct. 14, 1930.

A patent was issued to C. E. Pieck on Oct. 20, 1936 as U.S. Pat. No. 2,057,972. Yet another U.S. Pat. No. 3,123,246 was issued to R. P. Spinoza on Mar. 3, 1964.

A patent was issued to J. L. Gwilliam, Jr. et al. on Nov. 2, 1976 as U.S. Pat. No. 3,989,142 and W. G. Holt was issued U.S. Pat. No. 4,047,329 on Sep. 13, 1977. U.S. Pat. No. 4,485,923 was issued on Dec. 4, 1984 to R. A. Schwaikert. U.S. Pat. No. 4,886,179 was issued to W. T. Volk on Dec. 12, 1989 and U.S. Pat. No. 4,951,832 was issued on Aug. 28, 1990 to B. J. Tenney et al. A patent was issued to P. L. Havens et al. on Feb. 9, 1993 as U.S. Pat. No. 5,184,745 and R. L. Abrums was issued U.S. Pat. No. 5,586,656 on Dec. 24, 1996.

Another patent was issued to R. L. Abrums as U.S. Pat. No. 5,799,792 on Sep. 1, 1998 and a patent was issued to John L. Wallberg on Dec. 12, 2000 as U.S. Pat. No. 6,158,607.

While these container storage systems may be suitable for the purposes for which they were designed, they would not be as suitable for the purposes of the present invention, as hereinafter described.

U.S. Pat. No. 1,778,175

Inventor: Enoch E. Thune

Issued: Oct. 14, 1930

A combined container and flower pot comprising in combination, an open top receptacle tapering smaller toward its lower end, the bottom of the receptacle being formed with a circular depressed portion, a removable closure for the receptacle comprising a plate-like base having its central portion raised to form a circular projection having snug inner fitting engagement with the depressed portion when the closure forming member is placed against the bottom of the receptacle to provide a base for supporting same in an upright position, and an upstanding flared rim extending around the outer edge of the plate, said closure fitting entirely within the open upper end of the receptacle with the flared rim engaging snugly with the inner face of the upper open end portion of the receptacle, the lower portion of the receptacle being formed with drain openings.

U.S. Pat. No. 2,057,972

Inventor: Carl Edward Pieck

Issued: Oct. 20, 1936

In combination, a container and a lid therefore, means for selectively attaching said lid to the top of said container, whereby to close the latter, or to the bottom thereof to provide a stable base, a perforated bottom on said container and an interrupted edge on the exterior thereof to permit liquid to drain from the container interior to the base.

U.S. Pat. No. 3,123,246

Inventor: Rudolph P. Spinoza

Issued: Mar. 3, 1964

A semiflexible container lid comprising a generally circular lid having a circular center portion surrounded by a continuous series of polyhedrons, each consisting of an upwardly projecting arcuate triangular inner surface and an inwardly projecting inclined triangular upper surface, the points of juncture of said triangular surfaces forming an apex, the sidewalls of each polyhedron sloping outwardly and away from the triangular surfaces depending from the apex to form an irregular rectangle, each sidewall adjoining the sidewall of an adjacent polyhedron at the bottom edge thereof to form a valley which valley extends from the perimeter of the circular center portion to a backwall portion defined by the space between the sloping adjoining sidewalls said backwall portion being contiguous with the back edges of said sloping sidewalls, the back edge of said upper triangular surface and the top edge of said backwall portion being bounded on the outside by a contiguous border adapted to rest on the rim of a container, said border terminating in a downwardly and inwardly extending lip which is sufficiently flexible to expand over the rim of a container in a sealing relationship.

U.S. Pat. No. 3,989,142

Inventor: James L. Gwilliam, Jr. et al.

Issued: Nov. 2, 1976

A stackable container lid for a bucket containing hot foods and the like comprising a generally circular lid having center portion surrounded by a series of polyhedron, one plane of which extends upwardly at right angles from the lid surface thereby forming a perimeter into which the bottom of the bucket can be inserted. The lid may also contain vent holes in a rim on the outer perimeter of the container lid. The rim terminates in a downwardly extending lip adapted to snap over the top of the bucket in a sealing relationship.

U.S. Pat. No. 4,047,329

Inventor: William Gilbert Holt

Issued: Sep. 13, 1977

The invention is a dual purpose container and lid for foods, cosmetics, medicines, nursery products and the like which is convertible to a flower pot. The container body and lid incorporate structural features which facilitate removal of the primary product from the container and utilization of the container for potting, the lid of said container being removable for use as a base for said container.

U.S. Pat. No. 4,485,923

Inventor: Ralph A. Schwaikert

Issued: Dec. 4, 1984

A stackable, closable container is provided. The container has a generally cylindrical body portion and generally circular top and bottom end walls. The container has an opening at its top end wall and is plugged with a resiliently flexible cover. In a preferred embodiment, the cover acts as a child-resistant closure. The cover also acts as a female member which receives a male member on the bottom end of an identical container stacked above it. The weight of the top container, however, is supported by the raised flange on the top end wall of the container beneath it, such that no weight is supported by the closure itself. Additionally, the top raised flange of the container and its bottom chime extend outwardly approximately an equal distance such that when one container is adjacent to an identical container in a side-by-side relationship there is a space between the containers so as to avoid scuffing of the containers or labels affixed thereto.

U.S. Pat. No. 4,886,179

Inventor: William T. Volk

Issued: Dec. 12, 1989

An interlockable reusable container for a food product, especially for a leftover piece of pizza pie, made of a thermoplastic material comprising a pie-shaped base, two substantially flat side walls attached to the base meeting in a common vertex, one of these side walls having an exterior tongue member and the other having an exterior groove member which are shaped so that the reusable container is laterally interlockable with another reusable container, a rear wall attached to the side walls and the base and a removable lid having a lid panel which rests on the side walls and a plug member which fits in the top opening of the reusable container when the lid is in place on the container. The lid panel and base may have a similar tongue and groove system so that the reusable containers can be stacked compactly in stable vertical stacks. An optional ceramic heat retention plate having a plurality of feet members shaped to just fit in the reusable container resting on the base of the reusable container can be provided.

U.S. Pat. No. 4,951,832

Inventor: Brian J. Tenney et al.

Issued: Aug. 28, 1990

A set of containers, preferably graduated and conveniently ranging in size generally from ½ pint to 1 gallon, each having a lid that may be placed on top to seal its respective, container and also may be matingly attached to the bottom in order that a smaller container with lid attached may be nested in the next larger container for convenient storage without loss or misplacing the lid. The lid attached to the bottom is configured to provide a uniform space between the vertical sides and the bottoms of nested containers so that two nested containers may provide a double walled container with an air gap acting as thermal insulation. Each lid may have a rim with a scalloped outside surface to prevent trapping of air in the nested position that could otherwise impede removal of the container and its lid from a larger container. A flange or downturned lip may be provided adjacent the upper rim of the container to assist in supporting a smaller inner container or a larger in a spaced relationship. A preferred embodiment employs a button (or knob) in the lid to engage an appropriately shaped and sized recess in the bottom of the container or vice versa.

U.S. Pat. No. 5,184,745

Inventor: Petrina L. Havens

Issued: Feb. 9, 1993

A storage container set wherein the individual containers are sized and configured to be nestable one within the other during storage of the set. Each container includes a rim depending downwardly from the underside of the container and having a plurality of vertical slots formed therein. The container lid is removably affixed to the underside of the container during storage of the container set in the nested condition by way of an interlocking arrangement between the rim and an annular groove disposed in a face of the lid, or interlocking buttons or recesses.

U.S. Pat. No. 5,586,656

Inventor: Rolin L. Abrums

Issued; Dec. 24, 1996

A nestable and stackable storage unit including a lid and container is disclosed. The container comprises a base having an upwardly extending wall. The lid is a substantially planar member having top and bottom surfaces and peripheral edge. The lid can be connected to the top of container by pressing a rim located on the wall into a first groove located on the bottom surface of the lid. The lid can be connected to the bottom of the container by pressing a lip located on the base of the container into a second groove located on the bottom surface of the lid. The units can be stored by locating each lid on the base of the container, and nesting the units within one another. Each lid includes a ridge and recess on its top surface for allowing stacking of the same or different size containers upon one another.

U.S. Pat. No. 5,799,792

Inventor: Rolin L. Abrums

Issued: Sep. 1, 1998

A nestable and stackable storage unit including a lid and container is disclosed. The container comprises a base having an upwardly extending wall. The lid is a substantially planar member having top and bottom surfaces and peripheral edge. The lid can be connected to the top of container by locating a head on the rim into a groove located on the bottom surface of the lid. The lid can be connected to the bottom of the container by pressing the lid onto the base which also includes a head. The units can be stored by locating each lid on the base of the container, and nesting the units within one another. Each lid includes a ridge and recess on its top surface for allowing stacking of the same or different size containers upon one another.

U.S. Pat. No. 6,158,607

Inventor: John L. Wallberg

Issued: Dec. 12, 2000

A new storage container with attachable lid for preventing the lid from being lost when removed from the container. The inventive device includes a container having a generally cylindrical configuration. The container has an open upper end, a closed lower end, and a cylindrical side wall therebetween. A lid portion is adapted for selective snap engagement to both the open upper end and the closed lower end of the container.

SUMMARY OF THE PRESENT INVENTION

The present invention relates generally to container storage systems and, more specifically, to a space saving container storage system wherein a plurality of containers having similar shapes but different sizes may fit one inside the other. Each container includes a lid which is releasably securable to both an open end of the container and a base of the container. Each lid has a unique color which corresponds to the color of the outer edge of the base of its matching container for easy storage thereof.

A primary object of the present invention is to provide a container storage system that overcomes the short comings of the prior art.

Another secondary object of the present invention is to provide a container storage system including a plurality of containers having similar shapes.

Yet another object of the present invention is to provide a container storage system including a plurality of containers having different sizes.

Still yet another object of the present invention is to provide a container storage system wherein each container has one open side thereby forming a pool therein.

An even further object of the present invention is to provide a container storage system wherein each container includes a lid able to be releasably secured to both the open end and the base thereof.

Yet another object of the present invention is to provide a container storage system including a lip extending around the perimeter of each container at the open end thereof.

An even further object of the present invention is to provide a container storage system including a lip extending around the perimeter of the base of each container.

Still another object of the present invention is to provide a container storage system wherein each lid able to be releasably secured to the base of its respective container for easy storage thereof.

A further object of the present invention is to provide a container storage system wherein a smaller container having a lid releasably connected to the base of the container thereof is able to be received within the pool of a larger container.

Still another object of the present invention is to provide a container storage system wherein the lid of each respective container and the lip extending around the base of that container are color-coded for easily identifying which cover is paired with a particular container.

Another object of the present invention is to provide a container storage system for efficiently storing containers in a space-saving manner.

Still another object of the present invention is to provide a container storage system for containers that is simple and easy to use.

Still yet another object of the present invention is to provide a container storage system for containers that is inexpensive to manufacture and use.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
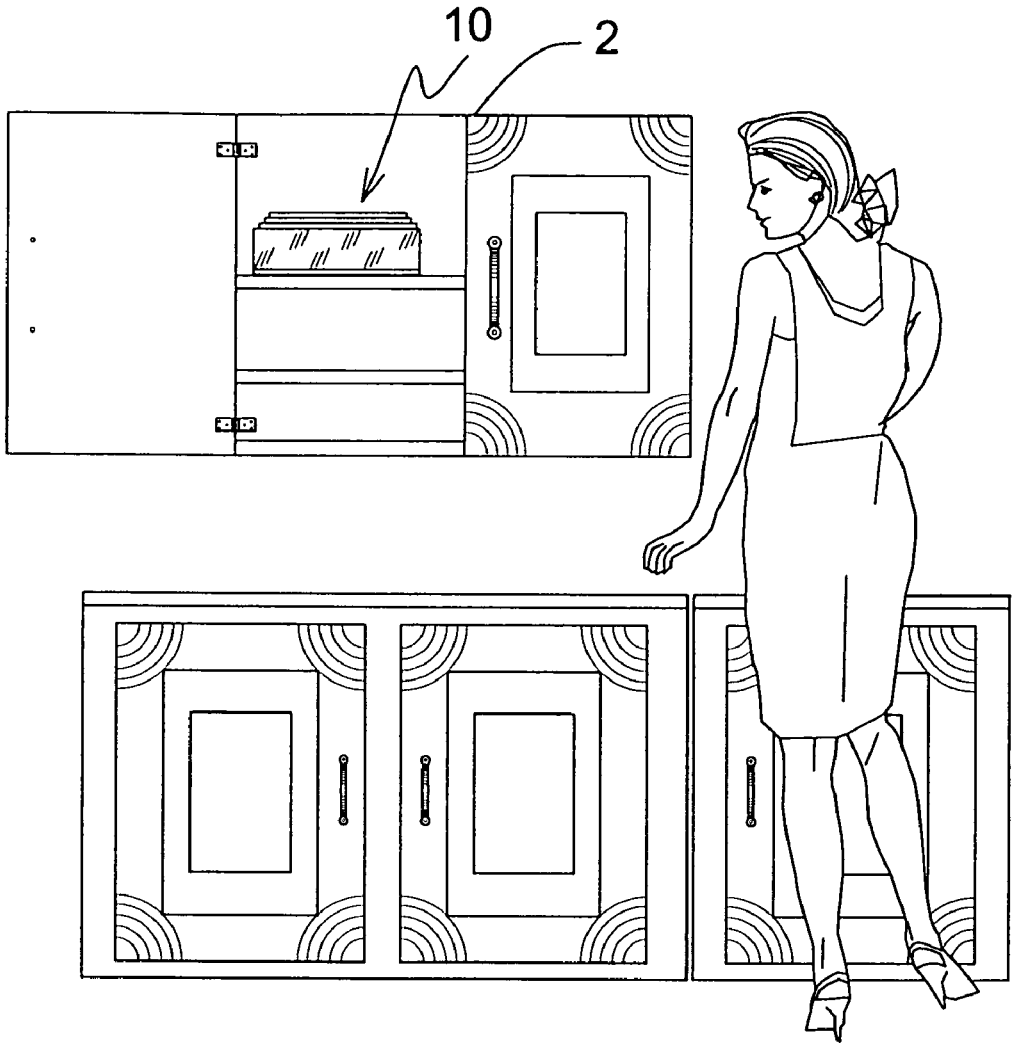
FIG. 1 is an illustrative view of the container storage system of the present invention being conveniently stored in a kitchen cabinet.

Turning now descriptively to the drawings, in which similar reference characters denote similar elements throughout the several views, the Figures illustrate the container storage system of the present invention. With regard to the reference numerals used, the following numbering is used throughout the various drawing figures.

2 cabinet
10 container storage system of the present invention
12 container
14 lid
16 wall
18 base
20 open end lip
22 base lip
24 retention channel
26 sealing mechanism
30 first container
31 first container lid
32 second container
33 second container lid
34 third container
35 third container lid
36 fourth container
37 fourth container lid

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 12 illustrate a container storage system of the present invention indicated generally by the numeral 10.

FIG. 1 is an illustrative view of the container storage system 10 of the present invention conveniently stored in a kitchen cabinet. The container storage system 10 includes a plurality of plastic containers each having similar shapes. Each respective container has a base and a wall extending therefrom along the periphery of the base to form a pool therein. The containers vary in size to one another whereby a plurality of smaller containers each fit securely within the pool of the next largest container. Each of the respective containers are preferably formed from a polymer substance however, the containers maybe formed of any material able to allow storage of items therein. Each respective container includes a lid which can be releasably secured to an open end of the container for storage of items in the pool thereof. The lid also is releasably securable to the base of the container thereby ensuring that each lid remains with its respective container when the containers are either opened or stored. As shown in FIG. 1, the container storage system 10 of the present invention is stored in a cabinet 2. Each respective lid is releasably secured to the base of its respective container. The lids are attached to the base of the container is shown clearly in FIG. 12. The container storage system 10 of the present invention ensures that each container will have a lid to enclose contents therein while allowing a plurality of unused storage containers to be stowed away in an efficient space-saving manner.

Figure 2:
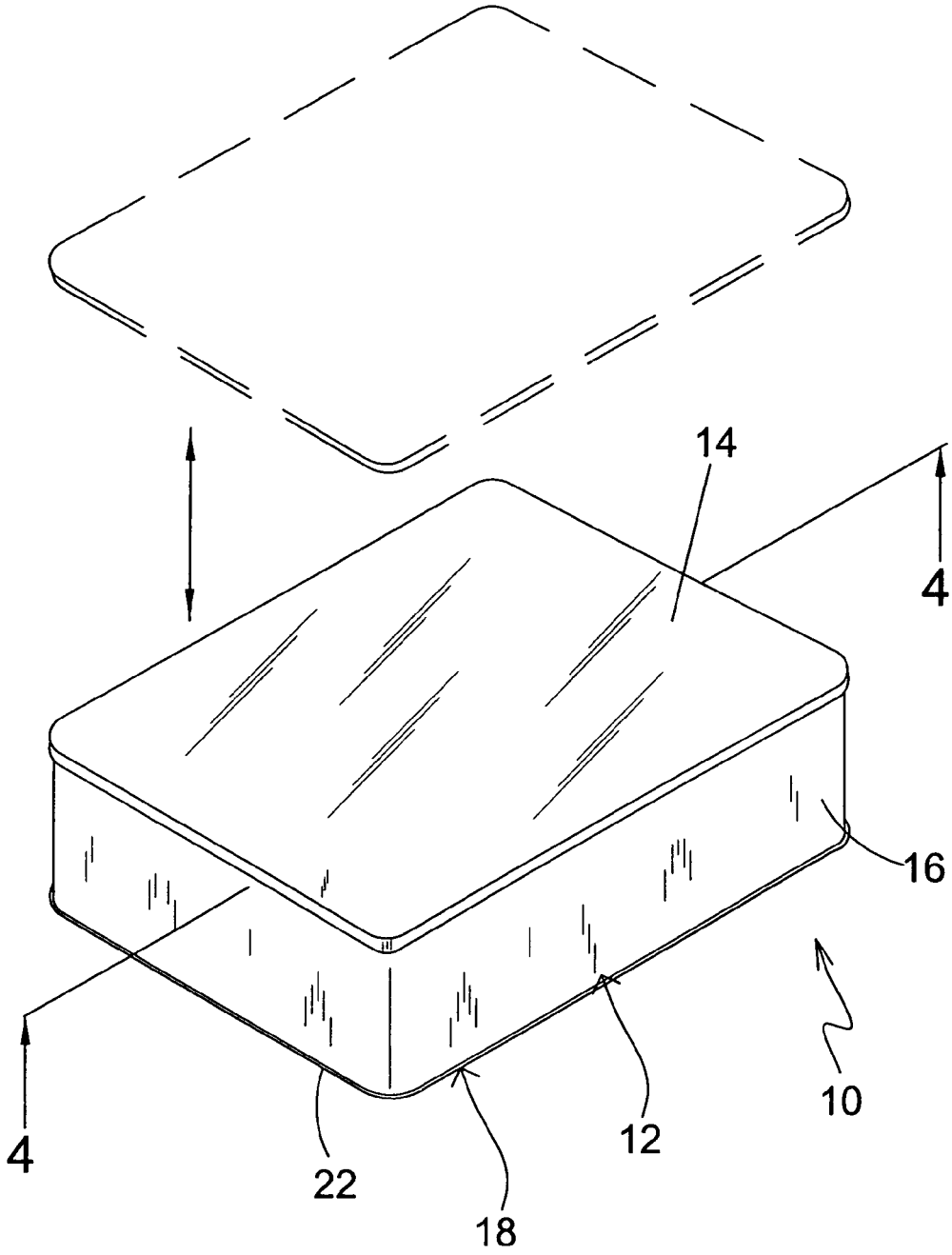
FIG. 2 is a perspective view of the container storage system of the present invention with the lid covering the open end of the container.
Figure 6:
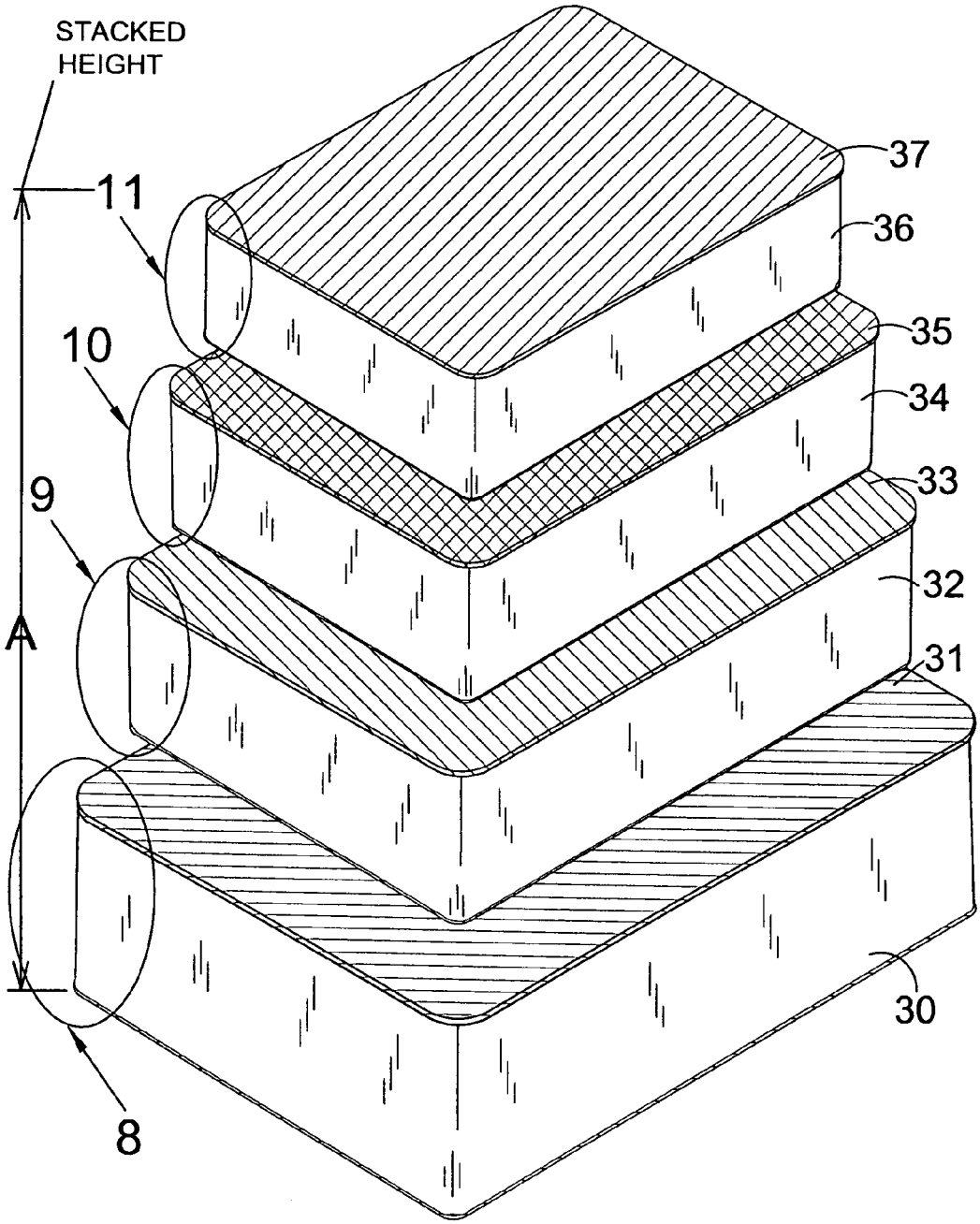
FIG. 6 is a perspective view of a plurality of containers that comprise the container storage system of the present invention stacked one on top of another.

FIG. 2 is a perspective view of a container 12 of the container storage system of the present invention with a lid 14 covering the open end of the container 12. The container storage system 10 includes a plurality of containers 12. Each container includes a base 18 and walls 16 which extend from and perpendicular to the base 18. The walls 16 and base 18 form a pool for receiving items for storage in the container 12. Extending around a perimeter of the open end of the container 12 on a side opposite the pool is an open end lip 20 as is shown clearly in FIG. 3. The open end lip 30 projects outwardly from the walls 16 and around the perimeter of the walls 16. A base lip 22 also extends outwardly from and around a perimeter of the wall adjacent the base 18. A lid 14 may be releasably secured the container at least one of the open end lip 20, as shown in FIG. 2, and the base lip 22. The lid 14 preferably snaps onto a lip 20, 22 of the container 12. As shown in FIG. 2, releasably securing the lid 14 to the open end allows for item to be stored within the pool of the container 12. The lid 14 being releasably secured to the open end of the container 12 also allows for the plurality of containers of the container storage system to be vertically stacked atop one another as shown in FIG. 6.

Figure 3:
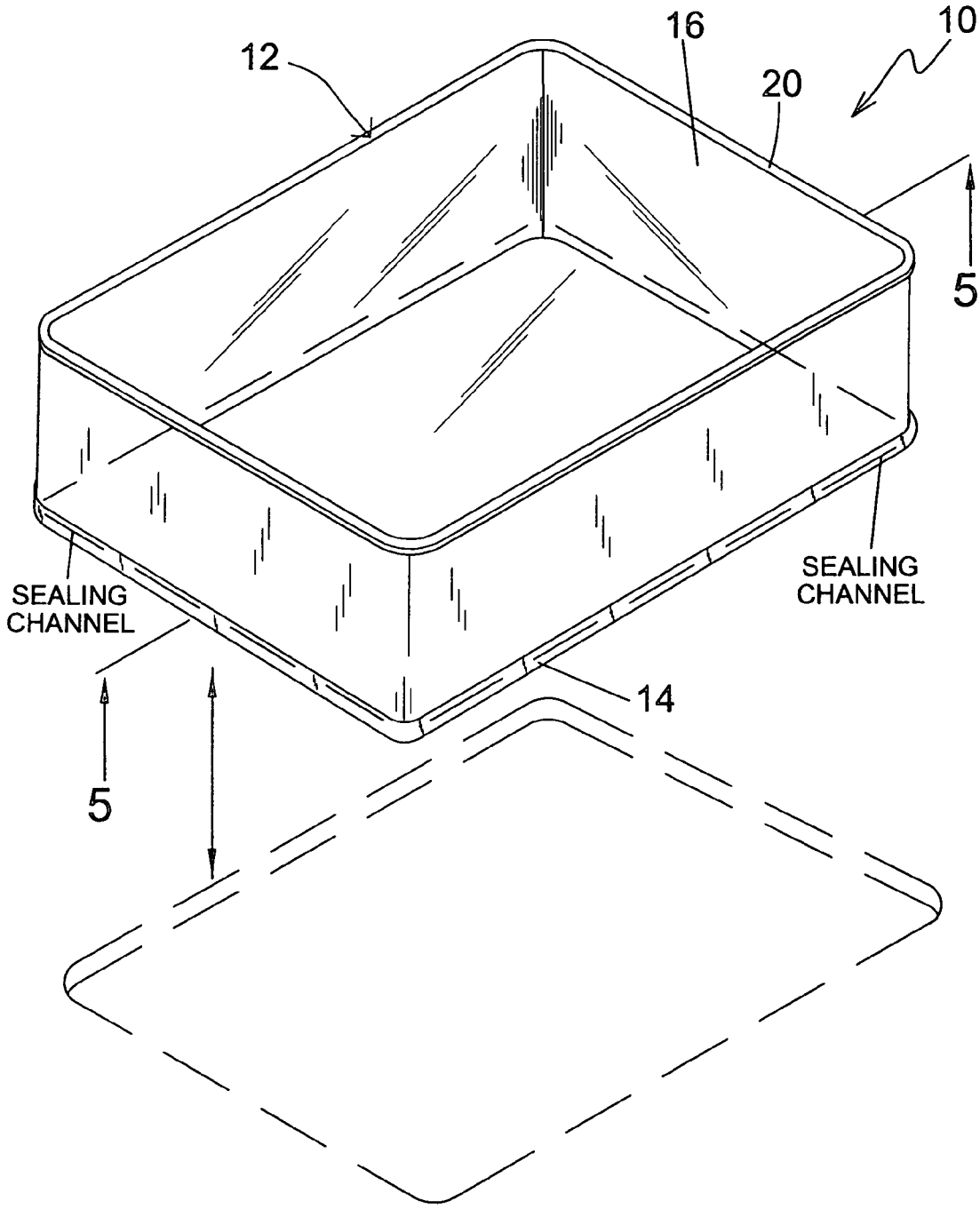
FIG. 3 is a perspective view of the container storage system of the present invention with the lid covering positioned adjacent to the base of the container.
Figure 7:
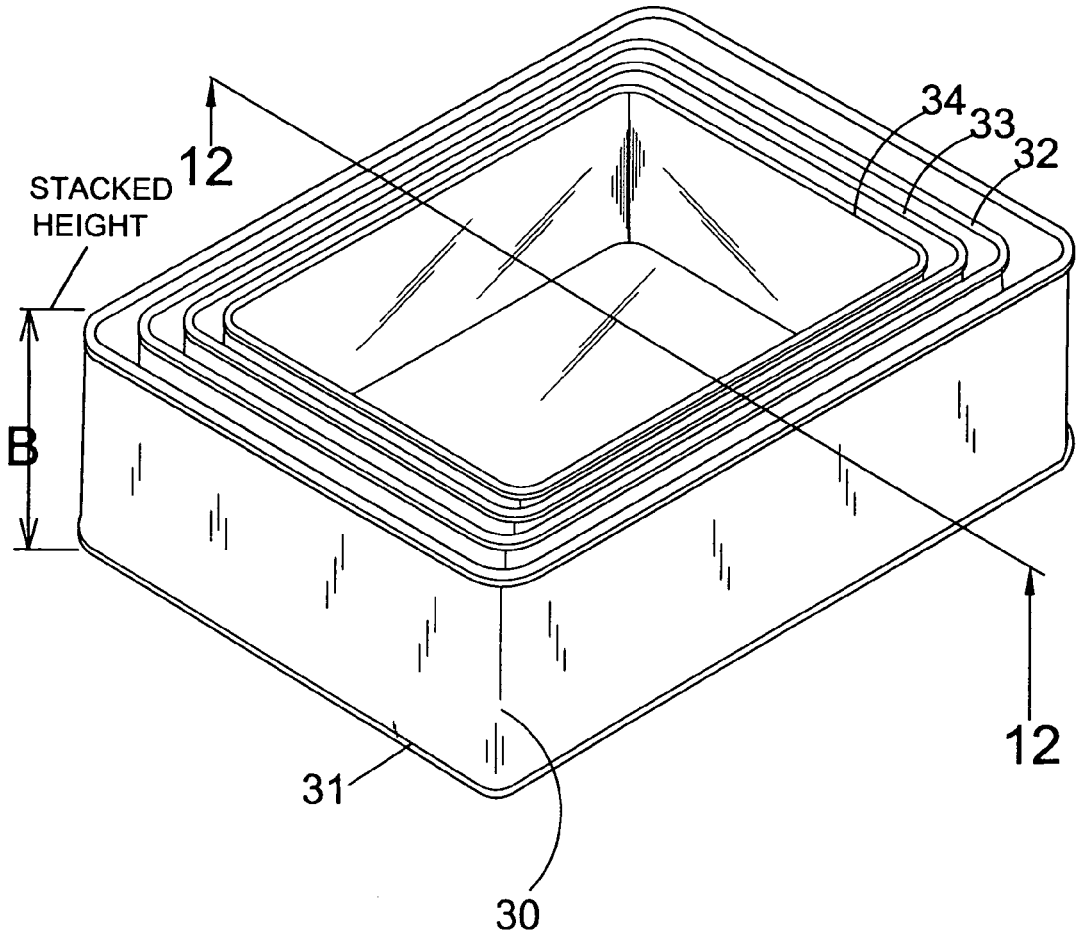
FIG. 7 is a perspective view of a plurality of containers of the container storage system of the present invention in the storage position wherein smaller containers are positioned within larger containers.

FIG. 3 is a perspective view of the container storage system of the present invention with the lid 14 positioned adjacent the base 18 of the container 12. The container storage system 10 includes a plurality of containers 12. Each container includes the base 18 and the walls 16 which extend from and perpendicular to the base 18. The walls 16 and base 18 form the pool for receiving items to be stored in the container 12. Extending around the perimeter of the open end of the container 12 on a side opposite the pool is the open end lip 20. The open end lip 20 protrudes outwardly from the walls 16 and extends around the perimeter of the walls 16. A base lip 22, as shown in FIG. 2, also extends outwardly from and around a perimeter of the wall adjacent the base 18. The lid 14 may be releasably secured to at least one of the open end lip 20 and the base lip 22. The lid 14 preferably snaps onto the lip 20, 22 of the container 12. As shown in FIG. 3, the lid 14 is snap fit onto base lip 22 thereby covering the base 18. Upon releasably securing the lid 14 to the base lip 22, the open end remains uncovered. In this position, a smaller container 12 is able to be stored within the pool the container 12. When all containers 12 are provided with the lid 14 releasably secured to their respective base lip 22, the containers may be stored one inside the other as shown in FIG. 7. This makes the container storages system 10 of the present invention easy to store and spatially efficiently.

Figure 4:
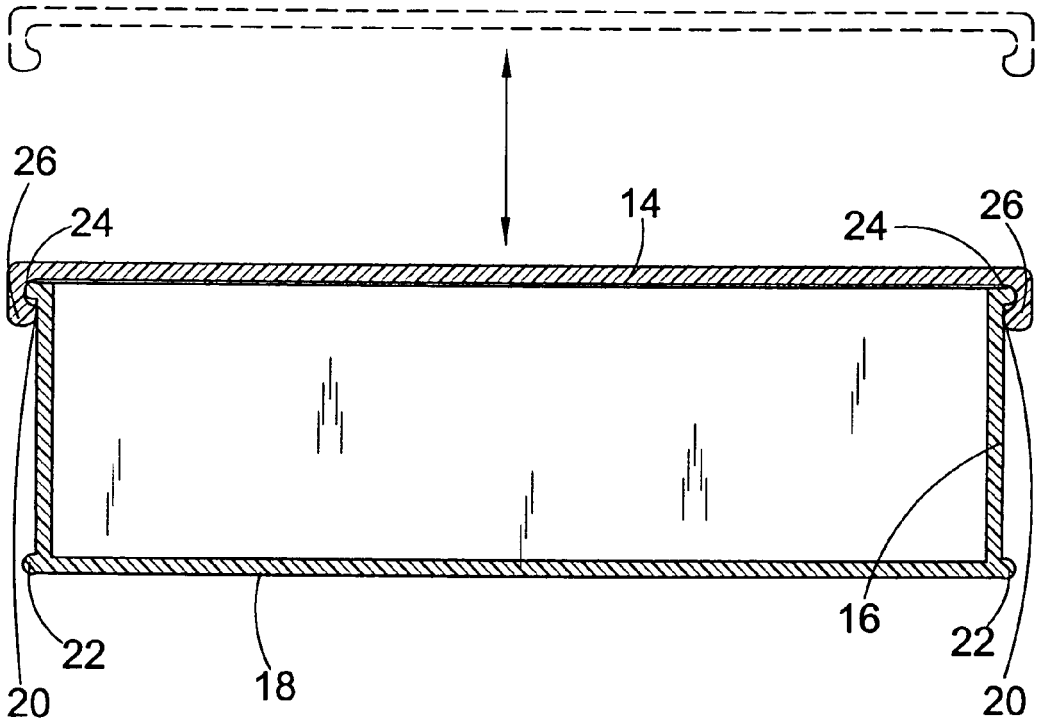
FIG. 4 is a cross-sectional view of the container storage of the present invention taken along line 4-4 in FIG. 2.

FIG. 4 is a cross-sectional view of the container storage of the present invention taken along line 4-4 in FIG. 2. The container storage system 10 includes a plurality of containers 12. Each container includes the base 18 and the walls 16 which extend from and perpendicular to the base 18. The walls 16 and base 18 form the pool for receiving items for storage in the container 12. Extending around the perimeter of the open end of the container 12 on the side opposite the pool is the open end lip 20 as is shown clearly in FIG. 3. The open end lip 20 projects outwardly from the walls 16 and around the perimeter of the walls 16. The base lip 22 also extends outwardly from and around a perimeter of the wall adjacent the base 18. The lid 14 may be releasably secured to the container at least one of the open end lip 20, as shown in FIG. 2, and the base lip 22. The lid 14 preferably snaps onto a lip 20, 22 of the container 12.

FIG. 4 shows the lid 14 having a lid edge 26 forming a retention channel 24 around the periphery of the lid 14. The retention channel 24 is able to receive the open end lip 22 that protrudes from the walls 16 of the container 12. Upon aligning the lid 14 with the open end of the container 12, the lid 14 may be secured by exerting pressure over the entire area of the lid 14. Upon exerting this pressure, the lid edge 26 is passed over the open end lip 22 thereby causing the open end lip 22 to be received within the retention channel 24 thereby releasably securing the lid 14 to the open end of the container 12. The lid 14 may be selective removed by gripping the lid edge 26 and pulling upward thereby unseating the open end lip 22 from the retention channel 24.

Figure 5:
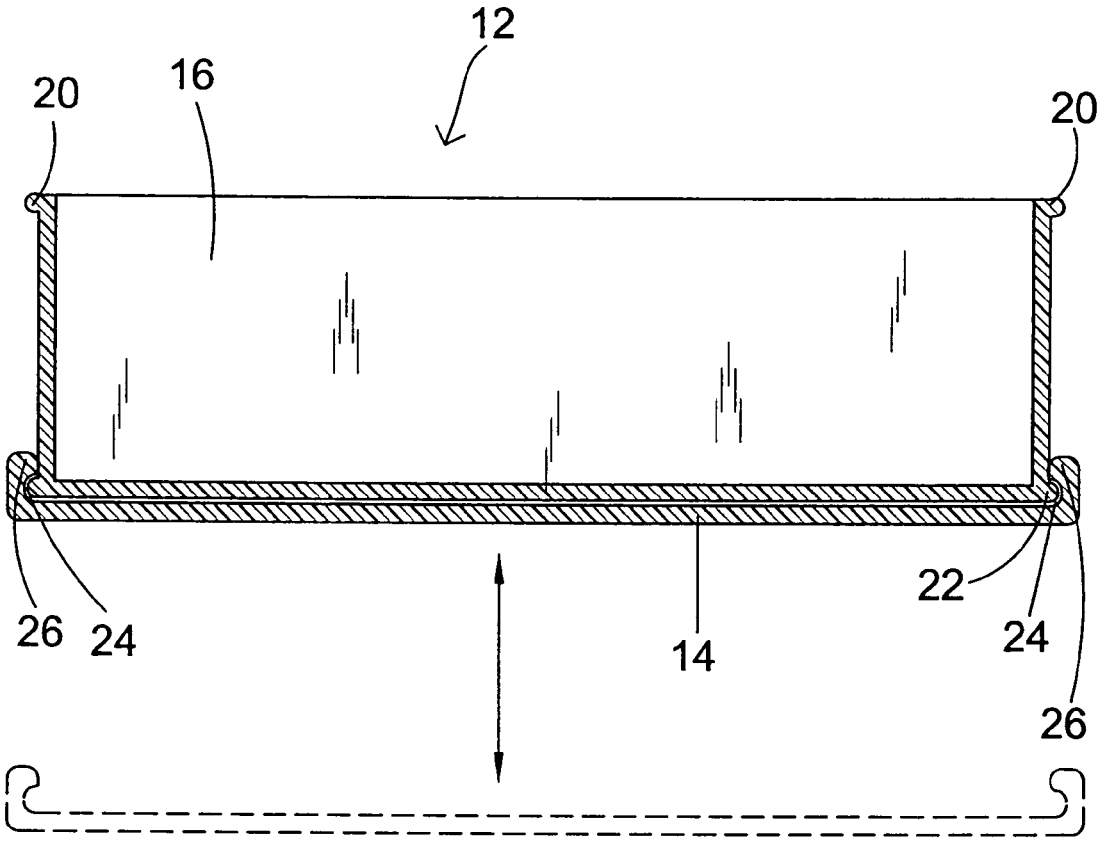
FIG. 5 is a cross-sectional view of the container storage of the present invention taken along line 5-5 in FIG. 3.

FIG. 5 is a cross-sectional view of the container storage of the present invention taken along line 5-5 in FIG. 3. The container storage system 10 includes a plurality of containers 12. Each container includes the base 18 and the walls 16 which extend from and perpendicular to the base 18. The walls 16 and base 18 form the pool for receiving items for storage in the container 12. Extending around the perimeter of the open end of the container 12 on the side opposite the pool is the open end lip 20 as is shown clearly in FIG. 3. The open end lip 20 projects outwardly from the walls 16 and around the perimeter of the walls 16. The base lip 22 also extends outwardly from and around a perimeter of the wall adjacent the base 18. The lid 14 may be releasably secured to the container at least one of the open end lip 20, as shown in FIG. 2, and the base lip 22. The lid 14 preferably snaps onto a lip 20, 22 of the container 12.

The lid 14 can also be releasably secured to the base 18 of the container 12 in a manner similar to releasably securing the lid 14 to the open end of the container 12. Upon aligning the lid 14 with the base 18, pressure is exerted over the area of the lid 14 in order to releasably secure the lid 14 to the base 18. Upon applying the pressure to the lid 14, the lid edge 26 is caused to pass over the base lip 22 so that the base lip 22 is received within the retention channel 24 of the lid 14. When the lid 14 is releasably secured to the base 18 of the container 12, the container 12 and lid 14 may be stored within the pool of a larger container 12 and also receive a smaller container 12 within the pool created by the walls 16. Placing a smaller container within a larger container allows for space saving storage of the container storage system of the present invention.

FIG. 6 is a perspective view of a plurality of containers that comprise the container storage system of the present invention. The container storage system 10, as shown in FIG. 6 includes a plurality of containers 12. A first container 30 is shown as the largest container 12. The first container 30 includes a first lid 31 which has a shape and size that corresponds to the first container 12. The second container 32 is the second largest container 12. A second claimer 32 has a second lid 32 which has a shape and size that corresponds to the second container 32. The second container 32 is shown stacked atop the first lid 31 of the first container 30. A third container 34 is the second smallest container 12. The third container 34 has a third lid 35 which has a shape and size that corresponds to the third container 34. The third container 34 is shown stacked atop the second lid 33 of the second container 32. A fourth container 36 is the smallest container 12. The fourth container 36 has a fourth lid 37 which has a shape and size that corresponds to the fourth container 36. The fourth container is shown stacked atop of the third lid 35 of the third container 34. The container storage system 10 of the present invention is described as having four containers only for illustrative purposes. Any number of containers having similar shapes but varying sizes may be incorporated into the system 10 of the present invention. Additionally, each of the lids 31, 33, 35, and 37 are color coded and have a color that corresponds with a color of the base lip 22.

As shown in FIGS. 1-5, each container includes the base 18 and the walls 16 which extend perpendicularly from the base 18. The walls 16 and base 18 form the pool within the container 12. Positioned around a periphery of the opposite the base 18 is the open end lip 20. The open end lip 20 protrudes outwardly from the walls 16 and extends around the perimeter of the wall 16. The base lip 22 also protrudes outwardly from and extends about a perimeter of the wall adjacent the base 18. The lid 14 may be releasably secured to at least one of the open end lip 20 and the base lip 22. The lid 14 is preferably snaps onto the lip 20, 22 of the container 12.

FIG. 7 is a perspective view of a plurality of containers of the container storage system of the present invention positioned one inside another in the storage position. When a user desires to store the plurality of containers of the container storage system 10 of the present invention, the user releasably secures the lid of the container to the base 18 of the container 12. As shown herein, the first through fourth containers 30, 32, 34, 36 have their respective lids 31, 33, 35, 37 releasably secured to the the respective bases 18 thereof. Thereafter, the fourth container 36 is positioned within the pool of the third container 34. The third container 34, having the fourth container 34 positioned therein, is then positioned within the pool of the second container 32. Thereafter, the second container 32, having both the third container 34 and the fourth container 36 therein, is within the pool of the first container 30. The containers 12 of the container storage system 10 are now easily stored in a spatially efficient manner.

Figure 8:
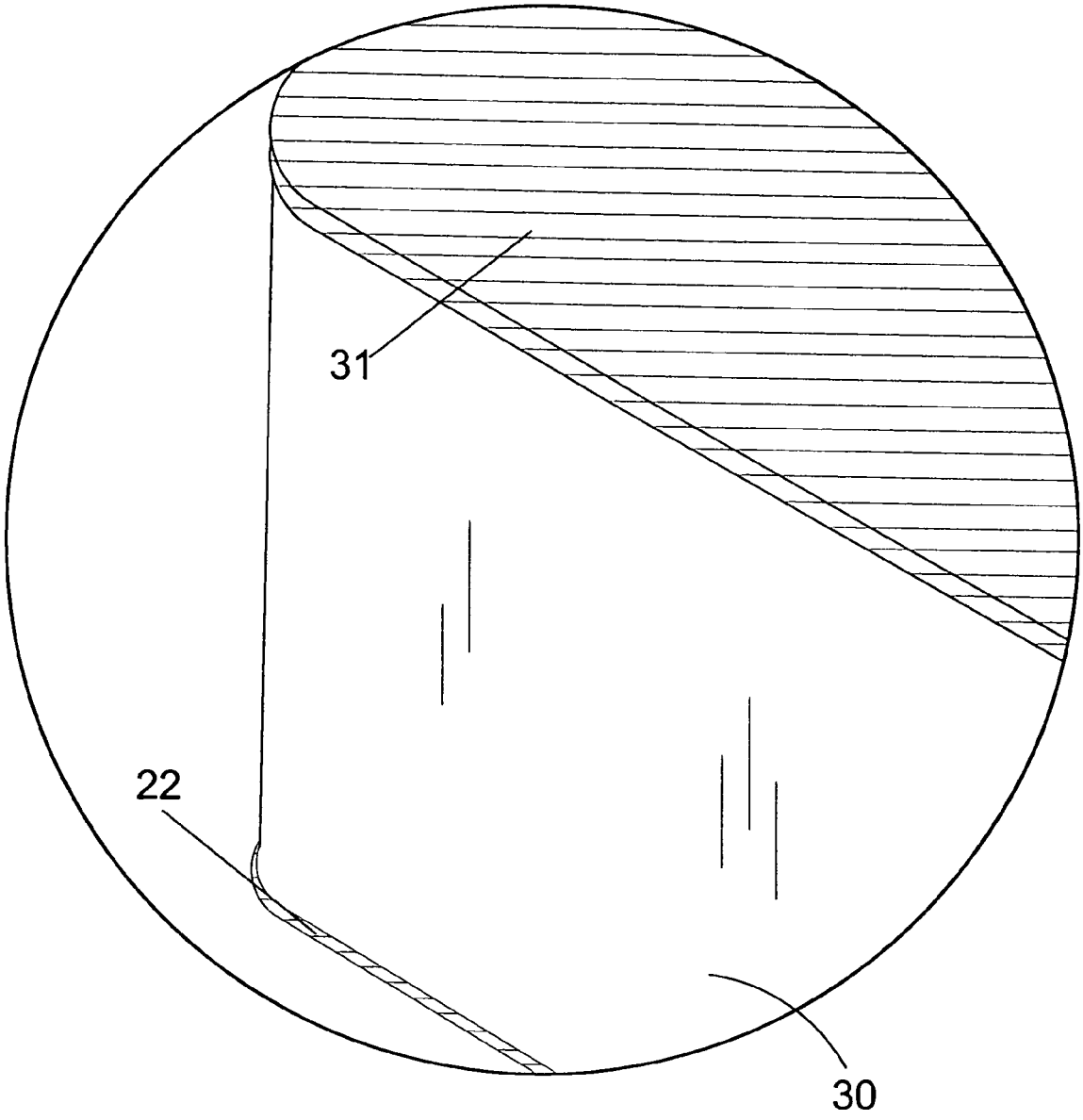
FIG. 8 is an enlarged perspective view of a corner of a container of the container storage system of the present invention having a colored lid that corresponds with the color of the lip extending around the base of the container having a first color.

FIG. 8 is an enlarged perspective view of the first container 30 of the container storage system of the present invention having a colored lid 31 that corresponds with the color of the lip 22 extending around the base 18 thereof, the colors of the lid and lip are indicated by hatching in FIG. 7. As shown in FIGS. 1-5, each container includes the base 18 and the walls 16 which extend from and perpendicular to the base 18. The walls 16 and base 18 form the pool for receiving items to be stored in the container 12. Extending around the perimeter of the open end of the container 12 on a side of the wall opposite the pool is the open end lip 20. The open end lip 20 protrudes outwardly from the walls 16 and extends around the perimeter of the walls 16. The base lip 22 also protrudes outwardly from and extends about a perimeter of the wall adjacent to the base 18. The lid 14 may be releasably secured to at least one of the open end lip 20 and the base lip 22. The lid 14 preferably snaps onto the lip 20, 22 of the container 12. FIG. 8 shows the lid 31 releasably connected to the open end lip 20 of the container 12. Upon releasably securing the lid 31 to the base lip 22, the first container is able to receive smaller containers within the pool thereof.

Figure 9:
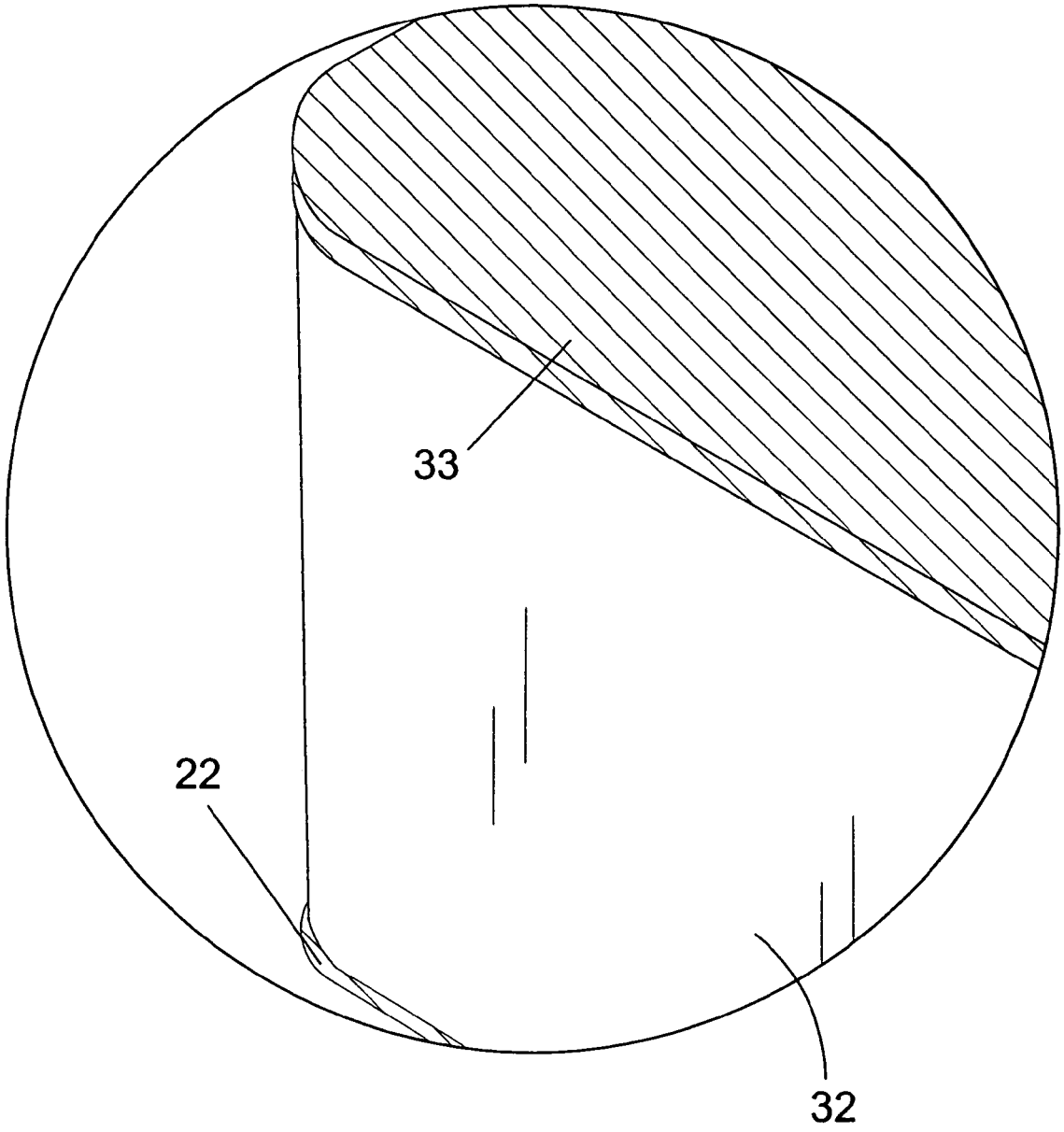
FIG. 9 is an enlarged perspective view of a corner of a container of the container storage system of the present invention having a lid and lip extending around the base of the container both having a second color.

FIG. 9 is an enlarged perspective view of the second container 32 of the container storage system 10 of the present invention having a second lid 33 having a color different from the color of any other container of the set and corresponding with the color of the lip 22 extending around the base thereof. As shown in FIGS. 1-5, each container includes the base 18 and the walls 16 which extend from and perpendicular to the base 18. The walls 16 and base 18 form the pool for receiving items to be stored in the container 12. Extending around the perimeter of the open end of the container 12 on a side of the wall opposite the pool is the open end lip 20. The open end lip 20 protrudes outwardly from the walls 16 and extends around the perimeter of the walls 16. The base lip 22 also protrudes outwardly from and extends about a perimeter of the wall adjacent to the base 18. The lid 14 may be releasably secured to at least one of the open end lip 20 and the base lip 22. The lid 14 preferably snaps onto the lip 20, 22 of the container 12. FIG. 9 shows the lid 33 releasably connected to the open end lip 20 of the container 12. Upon releasably securing the lid 33 to the base lip 22, the second container 32 is able to receive smaller containers within the pool thereof, as well as being positioned within the pool of a larger container thereof.

Figure 10:
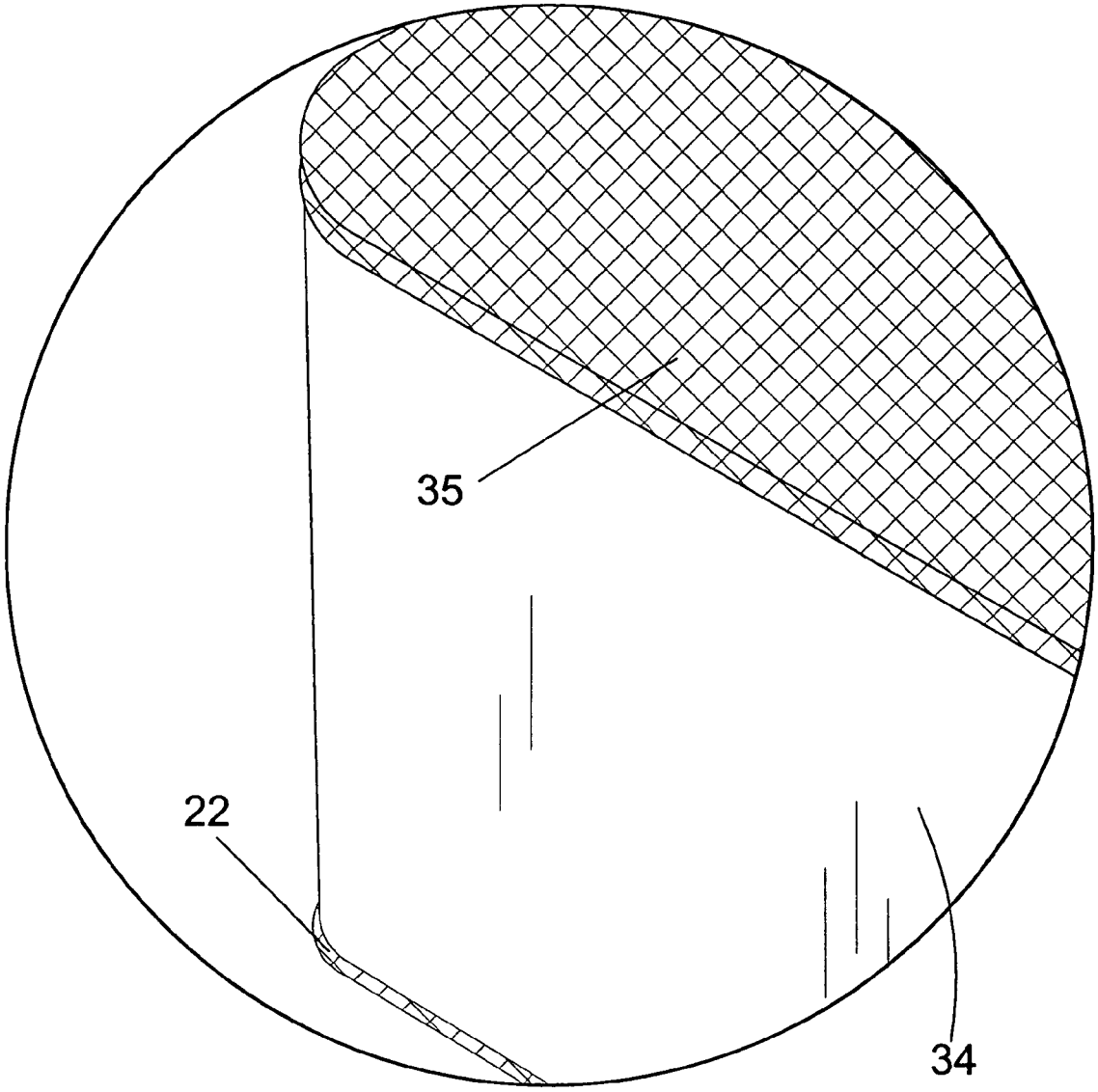
FIG. 10 is an enlarged the container perspective view of a container of the container storage system of the present invention having a colored lid and lip extending around the base of the container having a third color container.

FIG. 10 is an enlarged perspective view of the third container 34 of the container storage system 10 of the present invention having a colored third lid 35 having a color different from the color of any other container of the set and corresponds with the color of the lip 22 extending around the base 18 thereof. As shown in FIGS. 1-5, each container includes the base 18 and the walls 16 which extend from and perpendicular to the base 18. The walls 16 and base 18 form the pool for receiving items to be stored in the container 12. Extending around the perimeter of the open end of the container 12 on a side of the wall opposite the pool is the open end lip 20. The open end lip 20 protrudes outwardly from the walls 16 and extends around the perimeter of the walls 16. The base lip 22 also protrudes outwardly from and extends about a perimeter of the wall adjacent to the base 18. The lid 14 may be releasably secured to at least one of the open end lip 20 and the base lip 22. The lid 14 preferably snaps onto the lip 20, 22 of the container 12. FIG. 10 shows the third lid 35 releasably connected to the open end lip 20 of the container 12. Upon releasably securing the lid 35 to the base lip 22, the third container 34 is able to receive smaller containers within the pool thereof, as well as being positioned within the pool of a larger container thereof.

Figure 11:
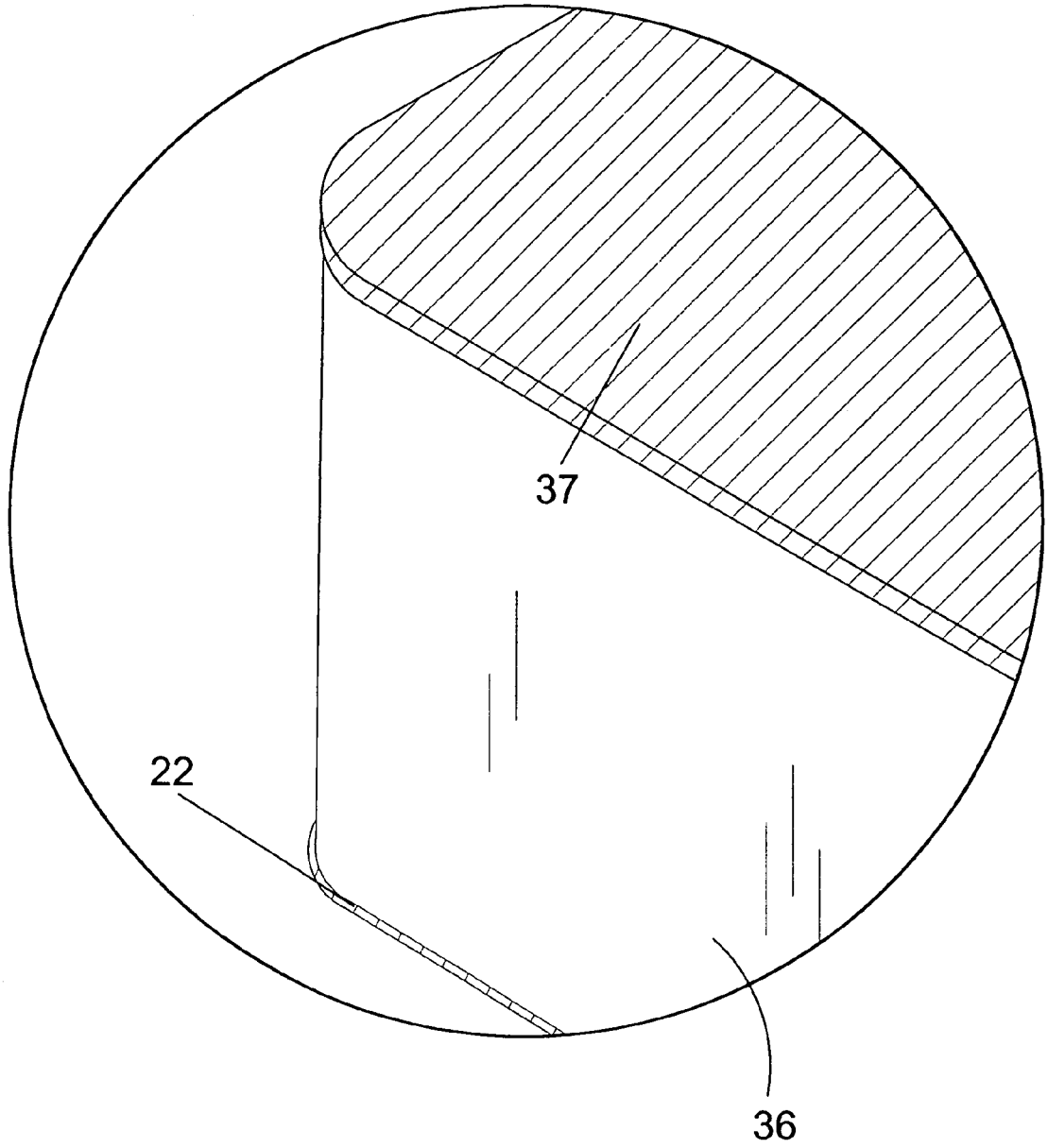
FIG. 11 is an enlarged perspective view of a corner of a container of the container storage system of the present invention having a colored lid and lip extending around the base of the container having a fourth color.

FIG. 11 is an enlarged perspective view of the fourth container 36 of the container storage system 10 of the present invention having a colored fourth lid 37 having a color different form the color of any other container of the set and corresponds with the color of the lip 22 extending around the base 18 thereof. As shown in FIGS. 1-5, each container includes the base 18 and the walls 16 which extend from and perpendicular to the base 18. The walls 16 and base 18 form the pool for receiving items to be stored in the container 12. Extending around the perimeter of the open end of the container 12 on a side of the wall opposite the pool is the open end lip 20. The open end lip 20 protrudes outwardly from the walls 16 and extends around the perimeter of the walls 16. The base lip 22 also protrudes outwardly from and extends about a perimeter of the wall adjacent to the base 18. The lid 14 may be releasably secured to at least one of the open end lip 20 and the base lip 22. The lid 14 preferably snaps onto the lip 20, 22 of the container 12. FIG. 11 shows the fourth lid 37 releasably connected to the open end lip 20 of the container 12. Upon releasably securing the lid 37 to the base lip 22, the fourth container 36 is able to receive smaller containers within the pool thereof, as well as being positioned within the pool of a larger container thereof.

Figure 12:
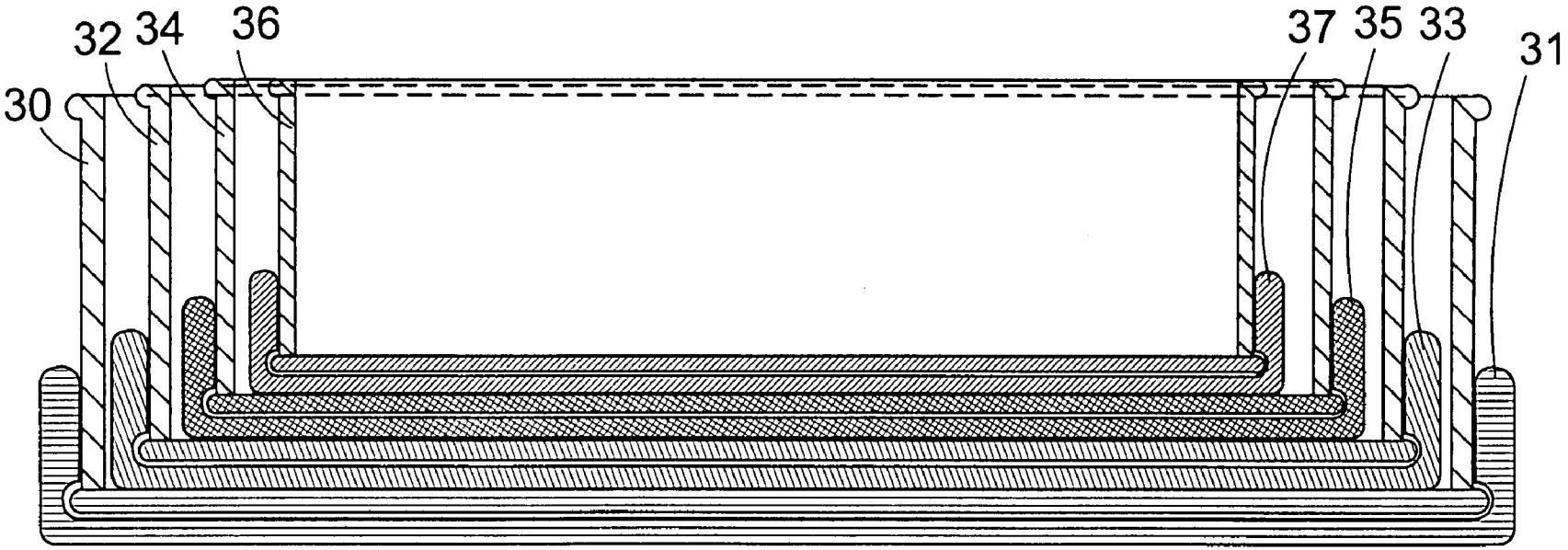
FIG. 12 is a cross-sectional view of a container storage system of the present invention taken along line 12-12 in FIG. 7.

FIG. 12 is a cross-sectional view of the container storage system of the present invention taken along line 12-12 in FIG. 7. Shown herein is the first container 30 having the first lid releasably secured to the base of the first container 30. Positioned within the pool of the first container 30 is the second container 32 having the second lid 33 releasably secured to the base of the second container 32. Positioned within the pool of the second container 32 is the third container 34 having the third lid releasably secured to the base of the third container 34. The fourth container 36 having the fourth lid 37 releasably secured to the base of the fourth container 36 is positioned within the pool of the third container 34. By positioning the smaller container within the pool of the larger container, valuable storage space is saved. Additionally, the container storage system 10 of the present invention ensures that the lids which are specifically fit for their specific container will be stored in close proximity of the container thereby reducing the possibility of the lid being lost or misplaced.

As described with specific reference to FIGS. 6-12, each lid 31, 33, 35, 37 is color coated to match the base lip of the respective containers 12. The colors associated with both the lids and base lips of the containers can be any known color that would ensure that a user knows that the lid corresponds to a specific container. Preferably, the colors of each lid and base lip combination with in a set are different so a not to cause confusion as to which lid belongs with which container. Additionally, the container storage system of the present invention can include any number of containers each having similar shapes so that the containers may fit within a pool of a larger container thereby maintaining spatial efficiency while preventing the lids for each of the respective containers from being lost.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A container storage system including a plurality of nestable containers, each container being of a different size, wherein each container includes:

a base and a flat lid; said base includes:

a wall extending up from and perpendicular to the base forming a pool therein, with an upper edge of said wall forming an open end of said container;

a first lip being an outwardly and radially extending rounded protrusion from the upper edge of said wall and beyond an outer surface of said wall around a periphery of said wall outside said pool on a side opposite said base, an upper surface of said first lip being an extension of the upper edge of said wall;

a second lip being an outwardly and a radially extending rounded protrusion around the periphery of said wall outside said pool, a bottom surface of said second lip being a smooth extension of a bottom surface of said base, said second lip extending beyond the outer surface of said wall, the outer surface of said wall extending smoothly and uninterruptedly with no offset portions between said first and second lips, said wall having a smooth outer surface between said first and second lips;

said flat lid having a shape and size that corresponds with a shape and size of said base, said lid including and limited to a single retaining channel extending around a periphery thereof for releasably receiving one of said first and second lips for releasably securing said lid to the open end of said container or said bottom surface of said base of said container for storage within a larger container, said retaining channel formed by an annular wall extending at a right angle to a plane of said flat lid from an outer edge of said lid and terminating in a bulbous annular edge extending radially inwardly, said bulbous annular edge being snapped onto either the first or second lip of said container; and said containers being color coded by having a lid color match a color of said second lip of each container base, said color of said second lip being limited to only the second lip of the base, at least one of said containers having a color different from any of the other containers.

2. The storage system of claim 1 in which said first and second lips are mirror images of each other.

3. The storage system of claim 1 in which said containers are formed from a polymer substance.

* * * * *